US011655819B2

(12) United States Patent
Ichise et al.

(10) Patent No.: US 11,655,819 B2
(45) Date of Patent: May 23, 2023

(54) SCROLL COMPRESSOR

(71) Applicant: MITSUBISHI HEAVY INDUSTRIES THERMAL SYSTEMS, LTD., Tokyo (JP)

(72) Inventors: Yuki Ichise, Tokyo (JP); Hiroshi Yamazaki, Tokyo (JP); Goshi Iketaka, Tokyo (JP); Shinya Hamamoto, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 74 days.

(21) Appl. No.: 17/260,173

(22) PCT Filed: Jun. 25, 2019

(86) PCT No.: PCT/JP2019/025051
§ 371 (c)(1),
(2) Date: Jan. 13, 2021

(87) PCT Pub. No.: WO2020/036002
PCT Pub. Date: Feb. 20, 2020

(65) Prior Publication Data

US 2021/0293240 A1 Sep. 23, 2021

(30) Foreign Application Priority Data

Aug. 13, 2018 (JP) ..... JP2018-152322

(51) Int. Cl.
*F04C 29/00* (2006.01)
*F04C 18/02* (2006.01)

(52) U.S. Cl.
CPC ..... *F04C 29/0057* (2013.01); *F04C 18/0215* (2013.01); *F04C 18/0253* (2013.01);
(Continued)

(58) Field of Classification Search
CPC ..... F04C 18/0215; F04C 18/0253; F04C 29/0057; F04C 2240/56; F04C 2240/60; F04C 2240/805; F04C 2240/807
See application file for complete search history.

(56) References Cited

U.S. PATENT DOCUMENTS

2008/0181791 A1* 7/2008 Iguchi ..... F04C 23/008 417/366
2010/0172781 A1* 7/2010 Kuwahara ..... F04C 18/0215 418/55.3

FOREIGN PATENT DOCUMENTS

CN 202937452 U 5/2013
EP 2 713 053 A1 4/2014
(Continued)

OTHER PUBLICATIONS

International Search Report and Written Opinion of the International Searching Authority for International Application No. PCT/JP2019/025051, dated Sep. 24, 2019. with English translation.

*Primary Examiner* — Mark A Laurenzi
*Assistant Examiner* — Xiaoting Hu
(74) *Attorney, Agent, or Firm* — Birch, Stewart, Kolasch & Birch, LLP

(57) ABSTRACT

A scroll compressor includes a base seat portion which is integrally formed with one end surface of a shaft and in which a press-fitting hole exposing a first hole portion is formed. The base seat portion is disposed in a second portion of a penetration portion with a gap interposed between a drive bush body and the base seat portion.

6 Claims, 5 Drawing Sheets

(52) U.S. Cl.
CPC ..... *F04C 2230/60* (2013.01); *F04C 2240/56* (2013.01); *F04C 2240/60* (2013.01); *F04C 2240/807* (2013.01)

(56) References Cited

FOREIGN PATENT DOCUMENTS

| | | | | | |
|---|---|---|---|---|---|
| EP | 2713053 | A1 | * | 4/2014 | ..... F01C 21/02 |
| EP | 3159544 | A1 | * | 4/2017 | ..... F04C 18/0215 |
| JP | H0719183 | A | * | 1/1995 | ..... F04C 18/0215 |
| JP | 2002-371376 | A | | 12/2002 | |
| JP | 2008-208717 | A | | 9/2008 | |
| JP | 2010-174796 | A | | 8/2010 | |
| JP | 2012-145120 | A | | 8/2012 | |
| JP | 2012-225328 | A | | 11/2012 | |
| WO | WO-2013175623 | A1 | * | 11/2013 | ..... F04B 39/0246 |

* cited by examiner

SCROLL COMPRESSOR

TECHNICAL FIELD

The present invention relates to a scroll compressor.

Priority is claimed on Japanese Patent Application No. 2018-152322, filed Aug. 13, 2018, the content of which is incorporated herein by reference.

BACKGROUND ART

A scroll compressor includes a scroll compression unit which includes a fixed scroll and an orbiting scroll with a boss portion, a shaft which rotates about a first axis, a drive bush which is accommodated in the boss portion, and an eccentric shaft which extends in a direction of a second axis parallel to the first axis and different from the first axis and is partially inserted into the drive bush.

Patent Document 1 discloses a technique of easily manufacturing the shaft and the eccentric shaft by separately forming the shaft and the eccentric shaft having a constant outer diameter in a longitudinal direction.

Further, Patent Document 1 discloses that the eccentric shaft is press-inserted into a fitting hole formed in the shaft.

CITATION LIST

Patent Document(s)

Patent Document 1: Japanese Unexamined Patent Application, First Publication No. 2002-371976

SUMMARY OF INVENTION

Technical Problem

However, when the eccentric shaft is supported in a cantilever state as in Patent Document 1, high stress is generated at a boundary portion between a fitting hole and the eccentric shaft (hereinafter referred to as a "base portion of the eccentric shaft") in the eccentric shaft during operation. Accordingly, there is a probability of a large load being applied to the base portion of the eccentric shaft.

Further, when a large load is applied to the base portion of the eccentric shaft as described above, there is a probability of the strength of the eccentric shaft decreasing. Accordingly, it has been difficult to decrease the outer diameter of the eccentric shaft. Therefore, there has been a problem of a radial size of the drive bush increasing.

Here, an object of the present invention is to provide a scroll compressor capable of decreasing a radial size of a drive bush while improving strength of an eccentric shaft.

Solution to Problem

In order to achieve the aforementioned object, a scroll compressor according to an aspect of the present invention includes: a fixed scroll which includes a first end plate portion and a first swirl portion formed upright in the first end plate portion; an orbiting scroll which includes a second end plate portion having one surface facing the first end plate portion, a second swirl portion formed upright in the one surface of the second end plate portion and joining with the first swirl portion to form a compression chamber, and a boss portion formed on the other surface of the second end plate portion located opposite to the one surface and protruding from the other surface; a shaft which includes a first hole portion formed on close to one end surface facing the other surface of the second end plate portion, extends in the direction of the first axis, and rotates about the first axis; a drive bush which includes a drive bush body formed between the second end plate portion and the one end surface of the shaft while being accommodated in the boss portion and a penetration portion penetrating the drive bush body in a direction from the second end plate portion toward the one end surface of the shaft; an eccentric shaft which is disposed in the first hole portion, a press-fitting hole through which the first hole portion is exposed, and the penetration portion and which extends in a direction of a second axis parallel to the first axis; and a base seat portion which is integrally formed with the one end surface of the shaft and is provided with the press-fitting hole, wherein the penetration portion includes a first portion which is disposed close to the orbiting scroll and a second portion which is disposed close to the shaft, which is communicated with the first portion, and a diameter of which is larger than that of the first portion, wherein the eccentric shaft is fitted into the first hole portion and the first portion and is press-inserted into the press-fitting hole, and wherein the base seat portion is disposed in the second portion with a gap interposed between the base seat portion and the drive bush body.

According to the present invention, since the base seat portion which is integrally formed with the one end surface of the shaft and is provided with the press-fitting hole exposing the first hole portion is provided and the base seat portion is disposed in the second portion of the penetration portion with the gap interposed between the drive bush body and the base seat portion, it is possible to improve the strength of the eccentric shaft (the base of the eccentric shaft) located in the vicinity of the one end surface of the shaft that easily generates high stress.

Further, it is possible to shorten the length of the eccentric shaft protruding toward the drive bush compared to a case in which the base seat portion is not provided. Accordingly, since it is possible to secure the strength of the eccentric shaft, it is possible to decrease the outer diameter of the eccentric shaft. Accordingly, it is possible to decrease the radial size of the drive bush to which the eccentric shaft is fitted.

Further, since the gap is interposed between the drive bush body and the base seat portion, it is possible to decrease a frictional force between the drive bush body and the base seat portion.

Further, in the scroll compressor according to the aspect of the present invention, the shaft may include a second hole portion which is formed close to the one end surface, a third hole portion may be formed in a portion of the drive bush body facing the second hole portion, the scroll compressor may further include a limit pin which extends in a direction of a third axis parallel to the first and second axes; and a rubber ring which is provided on an outer peripheral surface of the limit pin, part of the limit pin provided with the rubber ring may be accommodated in one of the second and third hole portions so that the rubber ring comes into contact with an inner peripheral surface of the one of the second and third hole portions, and the remaining part of the limit pin protruding from the one end surface of the shaft may be fitted into the other of the second and third hole portions.

In this way, when the second hole portion is formed in the shaft, the third hole portion facing the second hole portion is formed in the drive bush body, part of the limit pin is accommodated in the one hole portion, and the remaining part of the limit pin is fitted into the other hole portion, the position of the drive bush with respect to the shaft is regulated by two members (the eccentric shaft and the limit pin), and hence the swing amount can be decreased.

Further, when part of the limit pin provided with the rubber ring is accommodated in the one hole portion so that the rubber ring comes into contact with the inner peripheral surface of the one of the second and third hole portions, it is possible to alleviate an impact when a swing occurs.

Further, in the scroll compressor according to the aspect of the present invention, a center axis of the drive bush may be parallel to the first axis, and the second and third axes may be disposed at positions passing through a line orthogonal to the center axis.

In this way, when the second and third axes are disposed at the positions passing through the line orthogonal to the center axis of the drive bush, it is possible to dispose the third axis on the outside of the drive bush as much as possible and to secure the thickness of the limit pin.

Further, in the scroll compressor according to the aspect of the present invention, an annular diameter-reduced portion may be formed in an outer peripheral surface of drive bush body located close to the shaft, and the scroll compressor may further include a balance weight which includes a fitting penetration portion fitted to a portion of the drive bush in which the diameter-reduced portion is formed.

In this way, when the drive bush and the balance weight are formed as separate members, they have shapes which are easily processed compared to a case in which the drive bush and the balance weight are integrally formed with each other and hence the drive bush and the balance weight can be easily manufactured.

Further, the scroll compressor according to an aspect of the present invention may further include a bush radial bearing which is disposed between an inner peripheral surface of the boss portion and an outer peripheral surface of the drive bush body, the bush radial bearing may be a ball bearing, and a material of the drive bush may be cast iron.

In this way, when the ball bearing is used as the bush radial bearing disposed between the inner peripheral surface of the boss portion and the outer peripheral surface of the drive bush body, it is possible to decrease the inner diameter of the bush radial bearing. Accordingly, it is possible to decrease the outer diameter of the drive bush.

In this way, when the outer diameter of the drive bush is small, it is possible to use inexpensive cast iron and to decrease the cost of the drive bush.

Further, the scroll compressor according to an aspect of the present invention may further include: a motor which rotates the shaft; and a shaft radial bearing which rotatably supports an outer peripheral surface of a portion located between the motor and the drive bush in the shaft and an outer diameter of the base seat portion may be smaller than an inner diameter of the shaft radial bearing.

In this way, when the outer diameter of the base seat portion is smaller than the inner diameter of the shaft radial bearing, it is possible to decrease the radial size of the drive bush. Accordingly, it is possible to form a space for disposing the balance weight on the outside of the drive bush in the radial direction.

Advantageous Effects of Invention

According to the present invention, the strength of the eccentric shaft can be improved and the size of the drive bush in the radial direction can be decreased.

DESCRIPTION OF EMBODIMENTS

Hereinafter, an embodiment of the present invention will be described in detail with reference to the drawings.

Embodiment

Figure 1:
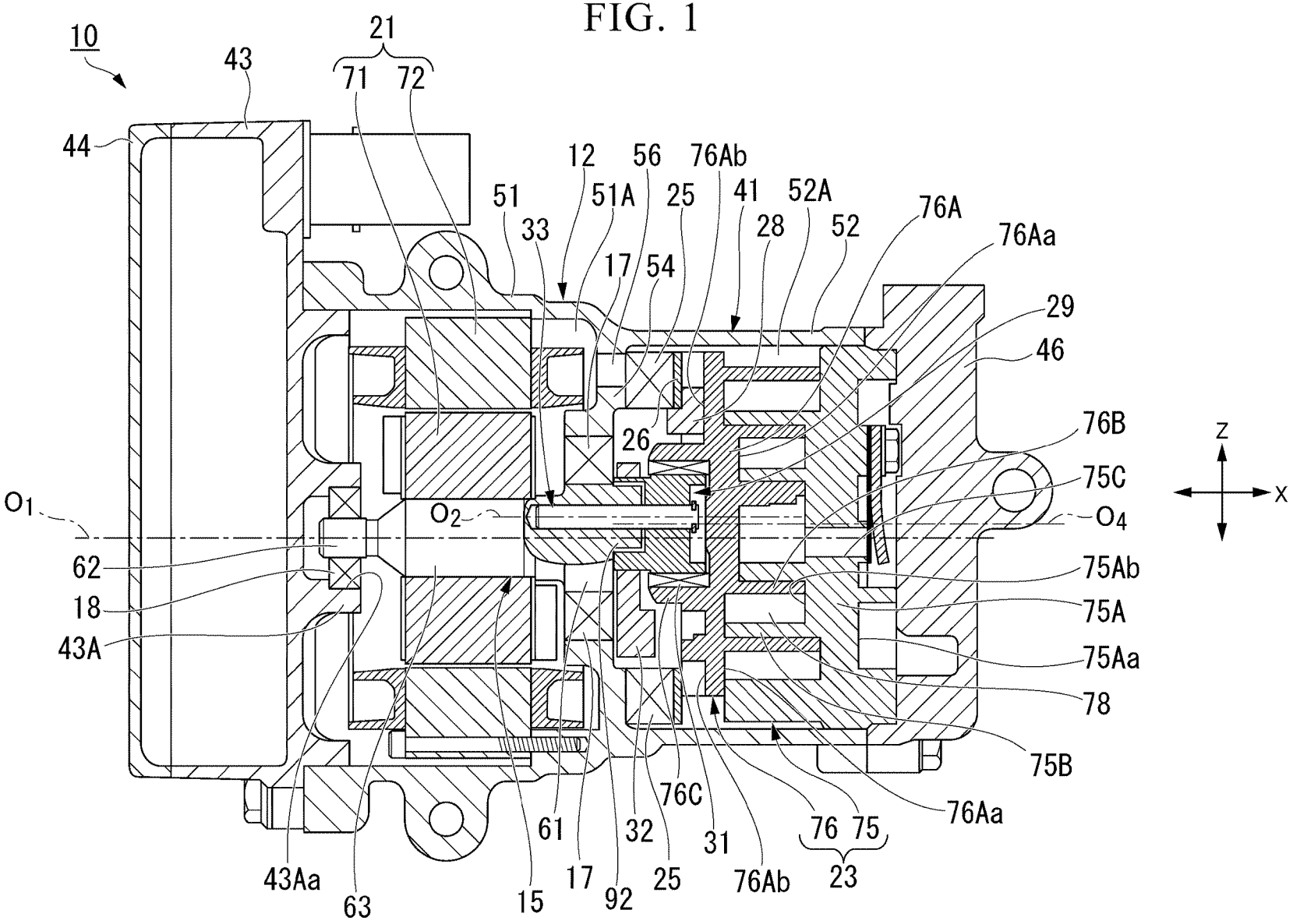
FIG. 1 is a cross-sectional view showing a schematic configuration of a scroll compressor according to an embodiment of the present invention.
Figure 2:
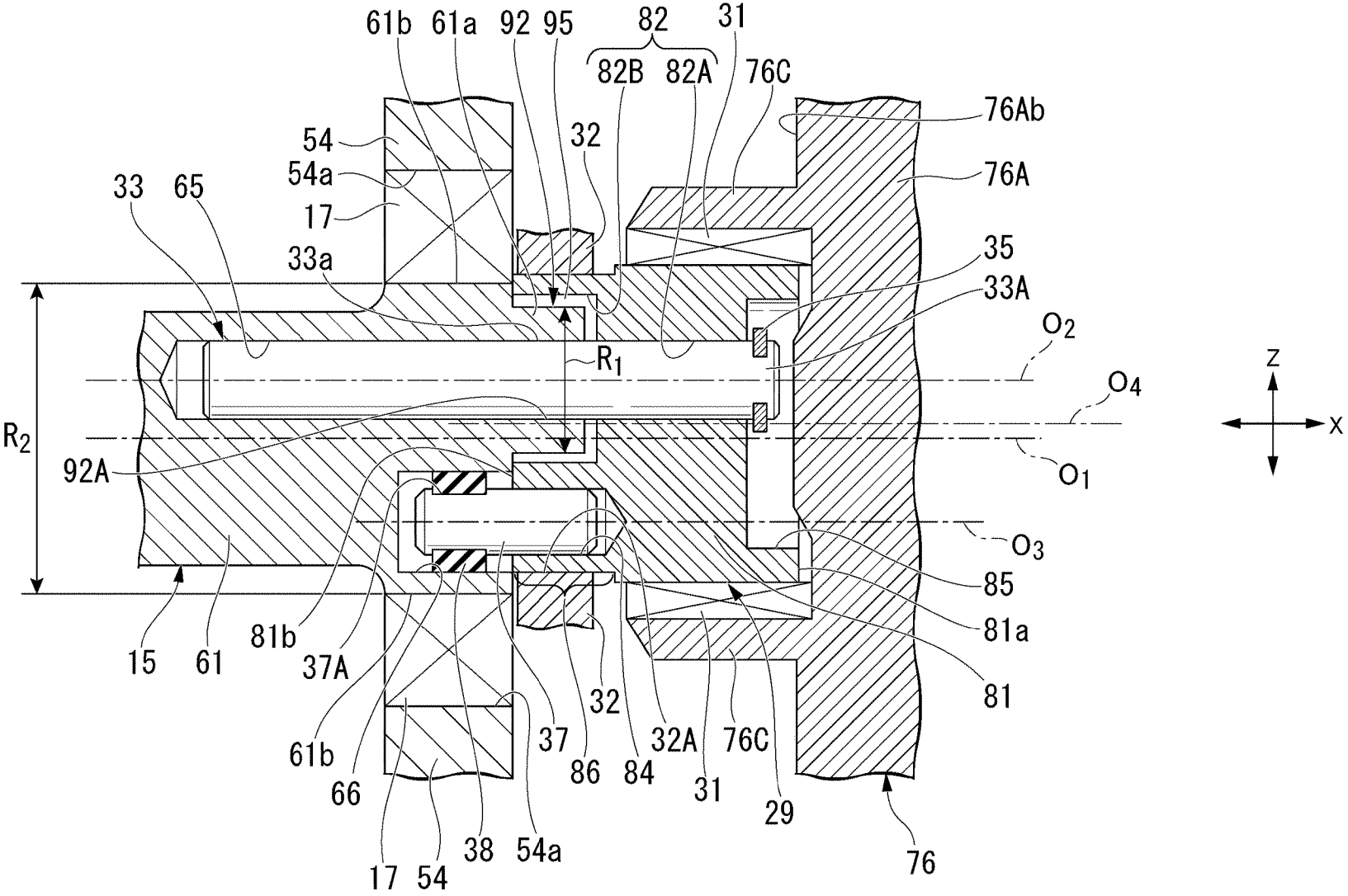
FIG. 2 is a cross-sectional view of a drive bush, an orbiting scroll, a shaft end portion, a shaft radial bearing, a bush radial bearing, and a balance weight through an eccentric shaft and a limit pin constituting the scroll compressor shown in FIG. 1.
Figure 3:
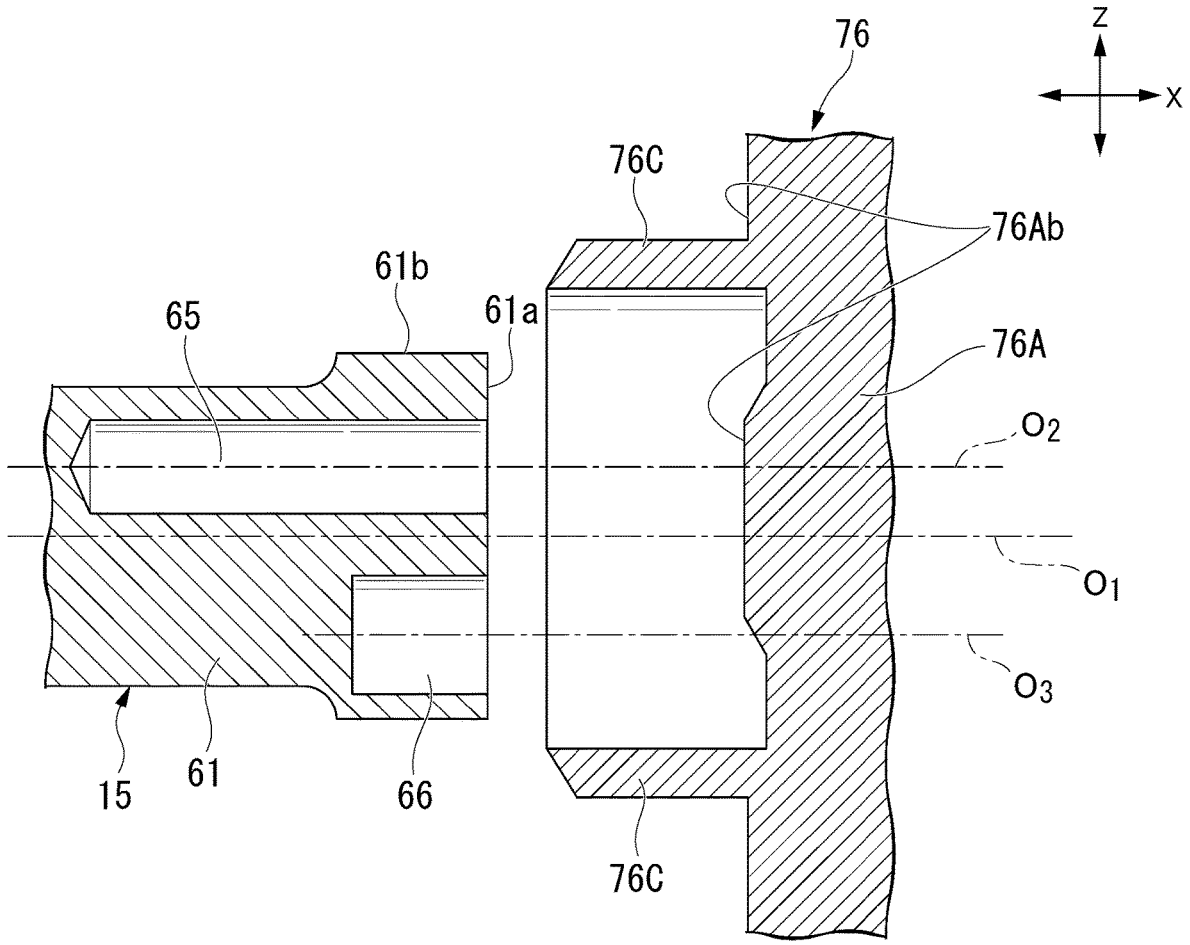
FIG. 3 is a cross-sectional view of the shaft end portion and the orbiting scroll shown in FIG. 2.
Figure 4:
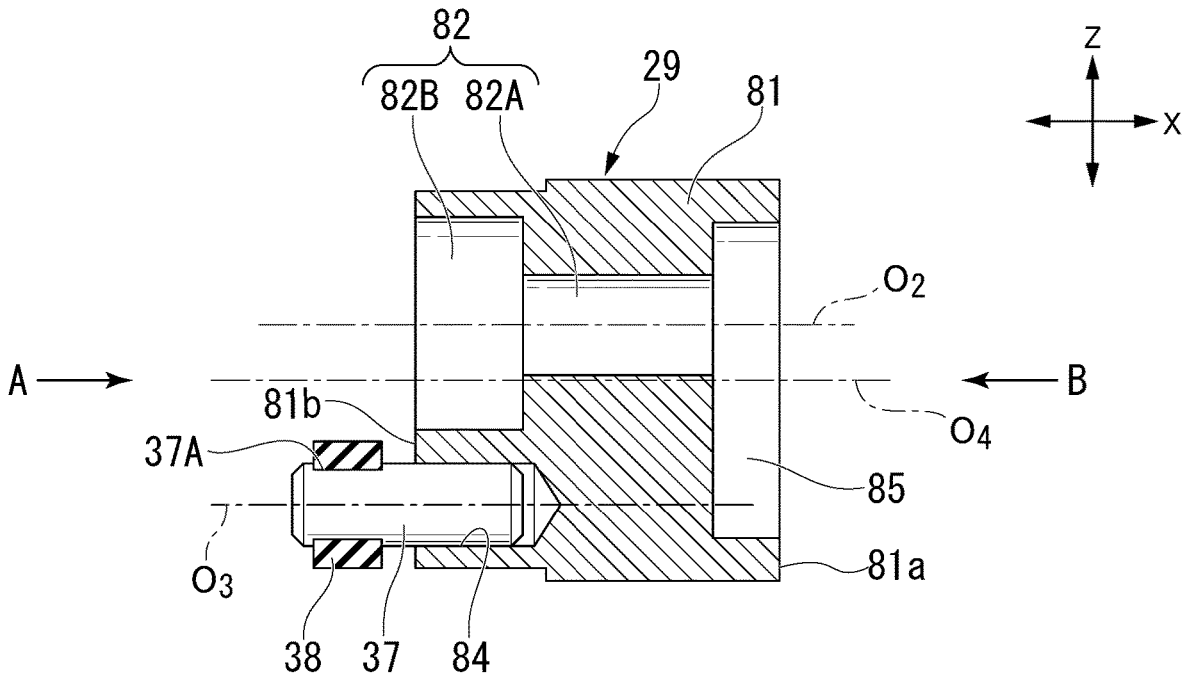
FIG. 4 is a cross-sectional view of the drive bush, the limit pin, and a rubber ring shown in FIG. 2.

A scroll compressor 10 according to an embodiment of the present invention will be described with reference to FIG. 1 to FIG. 6. A cross-section of FIG. 1 corresponds to a cross-section in a direction of a line $C_1$-$C_2$ shown in FIG. 5. In FIG. 2, $R_1$ indicates an outer diameter of a base seat portion 92 (hereinafter referred to as an "outer diameter $R_1$") and $R_2$ indicates an inner diameter of a shaft radial bearing 17 (hereinafter referred to as an "inner diameter $R_2$"). A cross-section of the structure shown in FIG. 2 and FIG. 4 corresponds to a cross-section in a direction of a line $D_1$-$D_2$ shown in FIG. 5.

Figure 5:
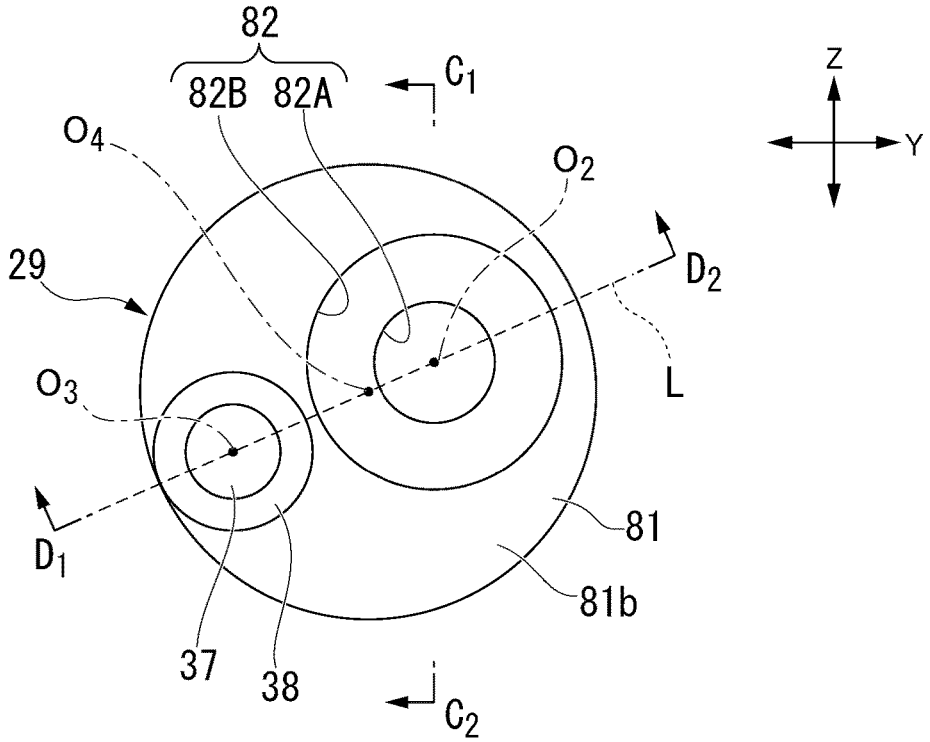
FIG. 5 is a plan view of the structure shown in FIG. 4 from A.
Figure 6:
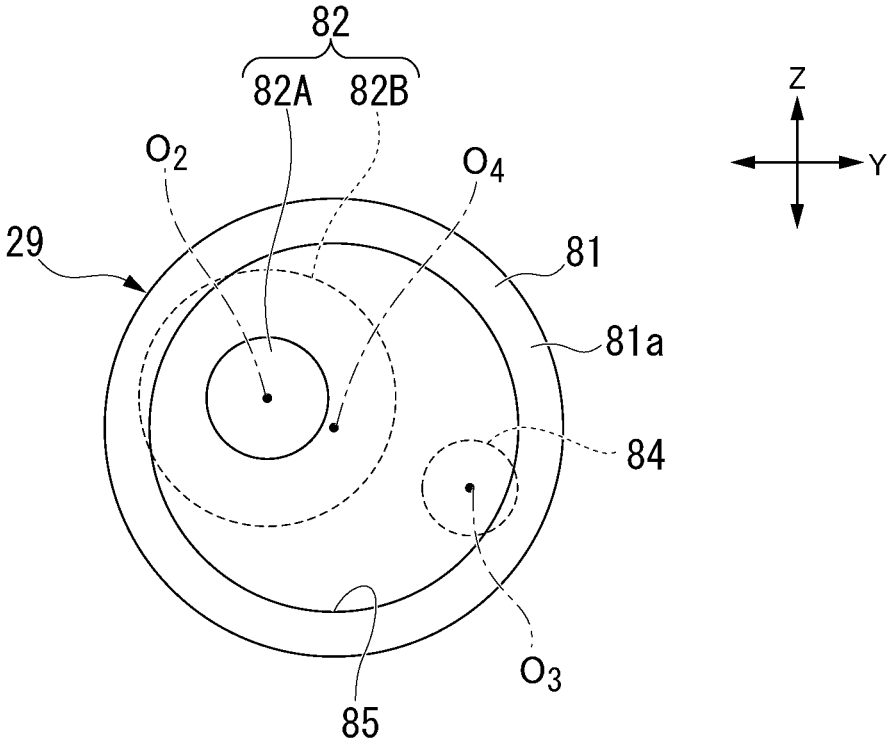
FIG. 6 is a plan view of the structure shown in FIG. 4 from B.

In FIG. 5, L indicates a line orthogonal to a center axis $O_4$ of a drive bush 29 (hereinafter referred to as a "line L").

In FIG. 1 to FIG. 6, $O_1$ indicates an axis of a shaft 15 (hereinafter referred to as a "first axis $O_1$"), $O_2$ indicates an axis of an eccentric shaft 33 (hereinafter referred to as a "second axis $O_2$"), $O_3$ indicates an axis of a limit pin 37 (hereinafter referred to as a "third axis $O_3$"), and $O_4$ indicates a center axis of a drive bush 29 (hereinafter referred to as a "center axis $O_4$").

Additionally, the first axis $O_1$ is also an axis of a casing 12.

The scroll compressor 10 includes the casing 12, the shaft 15, shaft radial bearings 17 and 18, a motor 21, a scroll compression unit 23, a thrust bearing 25, a thrust plate 26, an Oldham ring 28, the drive bush 29, a bush radial bearing 31, a balance weight 32, the eccentric shaft 33, a base seat portion 92, a snap ring 35, the limit pin 37, and a rubber ring 38.

The casing 12 includes a casing body 41, a cover 43, a first lid 44, and a second lid 46.

The casing body 41 includes a first cylindrical portion 51, a second cylindrical portion 52, and an annular portion 54.

The first cylindrical portion 51 is a member that is formed in a cylindrical shape about the first axis $O_1$. The first cylindrical portion 51 is formed such that both ends are open ends. The first cylindrical portion 51 includes a motor accommodation space 51A disposed therein. The motor accommodation space 51A is a columnar space.

The second cylindrical portion 52 is a member that is formed in a cylindrical shape about the first axis $O_1$. The second cylindrical portion 52 is formed such that both ends are open ends. The second cylindrical portion 52 includes a compression unit accommodating space 52A disposed therein. The compression unit accommodating space 52A is a columnar space.

The annular portion 54 protrudes from an inner peripheral surface of a boundary portion between the first cylindrical portion 51 and the second cylindrical portion 52 toward the inside of the casing body 41 in the radial direction. The annular portion 54 is provided with a flow passage 56 which allows the motor accommodation space 51A and the compression unit accommodating space 52A to communicate with each other.

The flow passage 56 functions as a flow passage through which a fluid or lubricating oil compressed by the scroll compression unit 23 moves.

The cover 43 is a member for partitioning a substrate chamber and is formed such that both ends are open ends. The cover 43 is provided at the open end located on the other side of the first cylindrical portion 51 in the X direction.

The cover 43 includes a boss portion 43A which extends to the inside of the motor accommodation space 51A. An annular diameter-enlarged portion 43Aa for disposing the shaft radial bearing 18 is formed inside the boss portion 43A.

The cover 43 with the above-described configuration is fixed to the first cylindrical portion 51 by, for example, a bolt or the like.

The first lid 44 is provided in the cover 43 to block an open end located on the other side of the cover 43 in the X direction.

The second lid 46 is provided in the second cylindrical portion 52 to block an open end located on one side of the second cylindrical portion 52 in the X direction. The second lid 46 is fixed to the second cylindrical portion 52 by, for example, a bolt or the like.

The shaft 15 is accommodated in the casing 12 and extends in the X direction. The shaft 15 includes one end portion 61, another end portion 62, and an intermediate portion 63.

The one end portion 61 is an end portion which is disposed on the other side in the X direction. The one end portion 61 is formed in a columnar shape and is formed to have a diameter larger than the intermediate portion 63. Part of the one end portion 61 is disposed inside the annular portion 54 and the remaining part is disposed in the motor accommodation space 51A.

The one end portion 61 includes an end surface 61*a* (one end surface), an outer peripheral surface 61*b*, a first hole portion 65, and a second hole portion 66.

The end surface 61*a* is an end surface disposed on the one side in the X direction. The end surface 61*a* faces the other surface 76Ab of a second end plate portion 76A constituting an orbiting scroll 76.

The outer peripheral surface 61*b* faces an inner peripheral surface 54*a* of the annular portion 54 while being separated from the annular portion 54.

The first hole portion 65 is a columnar hole about the second axis $O_2$. The first hole portion 65 extends in the direction of the second axis $O_2$. The first hole portion 65 is a hole for allowing the eccentric shaft 33 to be fitted to one end portion 61.

The second hole portion 66 is a columnar hole about the third axis $O_3$. The second hole portion 66 extends in the direction of the third axis $O_3$. The inner diameter of the second hole portion 66 is a size at which the limit pin 37 to which the rubber ring 38 is attached can be accommodated.

The other end portion 62 is an end portion which is disposed on the other side in the X direction. The other end portion 62 is formed in a columnar shape and is formed to have a smaller diameter than that of the intermediate portion 63. An outer peripheral surface of the other end portion 62 faces the diameter-enlarged portion 43Aa while being separated from the diameter-enlarged portion 43Aa in the radial direction.

The intermediate portion 63 is a columnar member that is disposed in the motor accommodation space 51A. The intermediate portion 63 connects the one end portion 61 and the other end portion 62 to each other.

The shaft radial bearing 17 is provided between the outer peripheral surface 61*b* of the one end portion 61 and the inner peripheral surface 54*a* of the annular portion 54. The shaft radial bearing 17 rotatably supports the one end portion 61 of the shaft 15.

The shaft radial bearing 18 is disposed between the outer peripheral surface of the other end portion 62 and the diameter-enlarged portion 43Aa. The shaft radial bearing 18 rotatably supports the other end portion 62 of the shaft 15.

The motor 21 includes a rotor 71 and a stator 72. The rotor 71 is fixed to the outer peripheral surface of the intermediate portion 63 constituting the shaft 15.

The stator 72 is formed in an annular shape about the first axis $O_1$. An outer peripheral surface of the stator 72 is fixed to an inner peripheral surface of the first cylindrical portion 51 with a gap interposed therebetween. The stator 72 is disposed on the outside of the rotor 71 in the radial direction with a gap interposed between the stator and the rotor 71.

The motor 21 with the above-described configuration rotates the shaft 15 about the first axis $O_1$.

The scroll compression unit 23 is disposed in the compression unit accommodating space 52A formed inside the casing body 41. The scroll compression unit 23 includes a fixed scroll 75 and the orbiting scroll 76.

The fixed scroll 75 and the orbiting scroll 76 are disposed in the X direction. The fixed scroll 75 is disposed between the second lid 46 and the orbiting scroll 76.

The fixed scroll 75 is fixed to an inner peripheral surface of the second cylindrical portion 52. The fixed scroll 75 includes a first end plate portion 75A, a first swirl portion 75B, and a discharge hole 75C.

The first end plate portion 75A is a circular plate member and includes one surface 75Aa and another surface 75Ab disposed on the side opposite to the one surface 75Aa. The one surface 75Aa faces the second lid 46. The other surface 75Ab faces the orbiting scroll 76.

The first swirl portion 75B is provided upright in the X direction from the other surface 75Ab of the first end plate portion 75A toward the orbiting scroll 76.

The discharge hole 75C is formed to penetrate the center portion of the first end plate portion 75A. The discharge hole 75C discharges a fluid compressed by the scroll compression unit 23 to the outside of the scroll compression unit 23.

The orbiting scroll 76 includes a second end plate portion 76A, a second swirl portion 76B, and a boss portion 76C. The second end plate portion 76A is a circular plate member and includes one surface 76Aa and another surface 76Ab disposed on the side opposite to the one surface 76Aa. The one surface 76Aa faces the other surface 75Ab of the first end plate portion 75A in the X direction. The other surface 76Ab faces the annular portion 54 in the X direction.

The second swirl portion 76B is provided upright in the X direction from the one surface 76Aa of the second end plate portion 76A toward the fixed scroll 75. The second swirl portion 76B joins with the first swirl portion 75B. A compression chamber 78 in which a fluid is compressed is formed between the orbiting scroll 76 and the fixed scroll 75.

The thrust bearing 25 is provided between the annular portion 54 and the thrust plate 26 disposed in the X direction.

The thrust plate 26 is provided between the thrust bearing 25 and the Oldham ring 28 disposed in the X direction.

The Oldham ring 28 is provided between the thrust plate 26 and the second end plate portion 76A disposed in the X direction.

The drive bush 29 includes a drive bush body 81, a penetration portion 82, a third hole portion 84, a hole portion 85, and a diameter reduced portion 86.

The drive bush body 81 is accommodated in the boss portion 76C with a gap between the drive bush body and the boss portion 76C. The drive bush body 81 is provided between the second end plate portion 76A and the end surface 61*a* (the one end surface) of the shaft 15.

The drive bush body 81 includes one surface 81*a* and another surface 81*b* disposed on the side opposite to the one surface 81*a*. The one surface 81*a* and the other surface 81*b* are surfaces disposed in the X direction. The one surface 81*a* faces the second end plate portion 76A. The other surface 81*b* is in contact with the end surface 61*a* of the shaft 15.

The penetration portion 82 is formed to penetrate a portion facing the first hole portion 65 formed in the one end portion 61 of the shaft 15 in the drive bush body 81 in the X direction (the direction from the second end plate portion 76A toward the end surface 61*a* of the shaft 15).

The penetration portion 82 includes a first portion 82A and a second portion 82B.

The first portion 82A is formed on the side of the second end plate portion 76A and extends in the X direction. The first portion 82A is a hole which is formed in a columnar shape. The inner diameter of the first portion 82A is set to substantially the same size as the outer diameter of the eccentric shaft 33.

The second portion 82B is formed on the side of the shaft 15 and extends in the X direction. The second portion 82B is a hole which is formed in a columnar shape. The second portion 82B communicates with the first portion 82A and has an inner diameter which is larger than the inner diameter of the first portion 82A.

The axes of the first and second portions 82A and 82B with the above-described configuration match the second axis $O_2$ of the eccentric shaft 33 accommodated in the first and second portions 82A and 82B.

The third hole portion 84 is formed on the side of the other surface 81*b* of the drive bush body 81 facing the second hole portion 66. The third hole portion 84 is formed in a columnar shape and extends in the X direction.

The inner diameter of the third hole portion 84 is formed to be smaller than the inner diameter of the second hole portion 66. The inner diameter of the third hole portion 84 is set to a size at which the limit pin 37 can be fitted thereto.

The hole portion 85 is formed on the side of the one surface 81*a* in the drive bush body 81. The hole portion 85 is a columnar hole having a diameter larger than that of the second portion 82B.

The bush radial bearing 31 is provided between an inner peripheral surface of the boss portion 76C and an outer peripheral surface of the drive bush 29. As the bush radial bearing 31, for example, a ball bearing may be used.

In this way, when the ball bearing is used as the bush radial bearing 31, the inner diameter of the bush radial bearing 31 can be decreased. Accordingly, the outer diameter of the drive bush 29 can be decreased.

In this way, when the outer diameter of the drive bush 29 decreases, inexpensive cast iron can be used as the material of the drive bush 29. Accordingly, the cost of the drive bush 29 can be decreased.

The diameter reduced portion 86 is formed in an annular shape in the outer peripheral surface located on the side of the shaft 15 in the drive bush body 81.

The balance weight 32 includes a fitting penetration portion 32A which is fitted to a portion provided with the diameter-reduced portion in the drive bush.

The fitting penetration portion 32A is fitted to a portion provided with the diameter reduced portion 86 in the drive bush 29.

That is, the balance weight 32 is formed as a separate member from the drive bush 29.

In this way, when the drive bush 29 and the balance weight 32 are formed as separate members, they have shapes which are easily processed compared to a shape in which the drive bush 29 and the balance weight 32 are integrated with each other and hence the drive bush 29 and the balance weight 32 can be easily manufactured.

The center axis $O_4$ of the drive bush 29 with the above-described configuration is an axis which extends in the X direction and is parallel to the first to third axes $O_1$, $O_2$, and $O_3$.

The eccentric shaft 33 extends in the direction of the second axis $O_2$. The eccentric shaft 33 is set to a size having a constant outer diameter. The eccentric shaft 33 is fitted (press-inserted) into the first hole portion 65 and the penetration portion 82. An end portion 33A of the eccentric shaft 33 located on the side of the second end plate portion 76A is disposed in the hole portion 85. The end portion 33A of the eccentric shaft 33 is disposed at a position separated from the second end plate portion 76A in the X direction.

The base seat portion 92 is integrally formed with the end surface 61*a* of the shaft 15 and is provided with a press-fitting hole 92A which exposes the first hole portion 65. The base seat portion 92 is disposed in the outer peripheral surface 33*a* located at the second portion 82B in the outer peripheral surface 33*a* of the eccentric shaft 33.

The base seat portion 92 forms a gap 95 between the base seat portion and the drive bush body 81 while being disposed in the second portion 82B.

In this way, when the base seat portion 92 which is integrally formed with one end surface 61*a* of the shaft 15 and is provided with the press-fitting hole 92A exposing the first hole portion 65 is provided and the base seat portion 92 is disposed in the second portion 82B of the penetration portion 82 with the gap 95 interposed between the drive bush body 81 and the base seat portion 92, it is possible to improve the strength of the eccentric shaft 33 (the base of the eccentric shaft) located in the vicinity of one end surface 61*a* of the shaft 15 that easily generates high stress.

Further, it is possible to shorten the length of the eccentric shaft 33 protruding toward the drive bush 29 compared to a case where the base seat portion 92 is not provided. Accordingly, since it is possible to secure the strength of the eccentric shaft 33, it is possible to decrease the outer diameter of the eccentric shaft 33. Accordingly, it is possible to decrease the radial size of the drive bush 29 to which the eccentric shaft 33 is fitted.

Further, since the gap 95 is interposed between the drive bush body 81 and the base seat portion 92, it is possible to decrease a frictional force between the drive bush body 81 and the base seat portion 92.

It is preferable that the outer diameter $R_1$ of the base seat portion 92 be smaller than, for example, the inner diameter $R_2$ of the shaft radial bearing 17.

In this way, when the outer diameter $R_1$ of the base seat portion 92 is set to be smaller than the inner diameter $R_2$ of the shaft radial bearing 17, it is possible to decrease the radial size of the drive bush 29. Accordingly, it is possible to form a space for disposing the balance weight 32 on the outside of the drive bush 29 in the radial direction.

The snap ring 35 is provided in the outer peripheral portion of the end portion 33A of the eccentric shaft 33. The snap ring 35 protrudes outward in the radial direction from the outer peripheral surface 33*a* of the end portion 33A of the eccentric shaft 33.

In this way, when the snap ring 35 is provided to protrude outward in the radial direction from the outer peripheral surface 33*a* of the end portion 33A of the eccentric shaft 33, it is possible to regulate the position of the eccentric shaft 33 in the X direction from the second end plate portion 76A toward the shaft 15.

The limit pin 37 is a columnar pin, part of the limit pin 37 is disposed in the second hole portion 66, and the remaining part thereof is fitted (press-inserted) to the third hole portion 84.

The limit pin 37 extends in the direction of the third axis $O_3$ parallel to the direction of the first axis $O_1$. An annular diameter-reduced portion 37A is formed in an outer peripheral surface of part of the limit pin 37.

The rubber ring 38 is disposed in the diameter-reduced portion 37A. The rubber ring 38 is disposed in the second hole portion 66 together with part of the limit pin 37.

Part of the limit pin 37 provided with the rubber ring 38 is accommodated in the second hole portion 66 so that the rubber ring 38 comes into contact with the inner peripheral surface of the second hole portion 66.

In this way, when part of the limit pin 37 provided with the rubber ring 38 is disposed in the second hole portion 66 and the remaining part of the limit pin 37 is fitted (press-inserted) to the third hole portion 84, the position of the drive bush 29 with respect to the shaft 15 is regulated by two members (the eccentric shaft 33 and the limit pin 37) and hence the swing amount can be decreased.

Further, when part of the limit pin 37 provided with the rubber ring 38 is accommodated so that the rubber ring 38 comes into contact with the inner peripheral surface of the second hole portion 66, it is possible to alleviate an impact when a swing occurs.

It is preferable that the second and third axes $O_2$ and $O_3$ be disposed at, for example, a position passing through the line L orthogonal to the center axis $O_4$ of the drive bush 29.

In this way, when the second and third axes $O_2$ and $O_3$ are disposed at positions passing through the line L orthogonal to the center axis $O_4$ of the drive bush 29, the position of the third axis $O_3$ can be disposed on the outside of the drive bush 29 as much as possible and the thickness of the limit pin 37 can be secured.

According to the scroll compressor 10 of this embodiment, when the base seat portion 92 which is integrally formed with one end surface 61*a* of the shaft 15 and is provided with the press-fitting hole 92A exposing the first hole portion 65 is provided and the base seat portion 92 is disposed in the second portion 82B of the penetration portion 82 with the gap 95 interposed between the drive bush body 81 and the base seat portion 92, it is possible to improve the strength of the eccentric shaft 33 located in the vicinity of one end surface 61*a* of the shaft 15 that easily generates high stress (the base of the eccentric shaft).

Further, it is possible to shorten the length of the eccentric shaft 33 protruding toward the drive bush 29 compared to a case in which the base seat portion 92 is not provided. Accordingly, since it is possible to secure the strength of the eccentric shaft 33, it is possible to decrease the outer diameter of the eccentric shaft 33. Accordingly, it is possible to decrease the radial size of the drive bush 29 to which the eccentric shaft 33 is fitted.

Further, since the gap 95 is interposed between the drive bush body 81 and the base seat portion 92, it is possible to decrease a frictional force between the drive bush body 81 and the base seat portion 92.

Although the preferred embodiment of the present invention has been described in detail above, the present invention is not limited to such a specific embodiment and can be modified and changed in various forms in the scope of the spirit of the present invention described in claims.

For example, in this embodiment, a case in which the second hole portion 66 is formed in the shaft 15 and the third hole portion 84 is formed in the drive bush body 81 has been described as an example. However, the third hole portion 84 to which the remaining part of the limit pin 37 is fitted (press-inserted) may be formed in the shaft 15 and the second hole portion 66 accommodating part of the limit pin 37 provided with the rubber ring 38 may be formed in the drive bush body 81.

INDUSTRIAL APPLICABILITY

The present invention is applicable to a scroll compressor.

REFERENCE SIGNS LIST

10 Scroll compressor
12 Casing
15 Shaft
17, 18 Shaft radial bearing
21 Motor
23 Scroll compression unit
25 Thrust bearing
26 Thrust plate
28 Oldham ring
29 Drive bush
31 Bush radial bearing
32 Balance weight
32A Fitting penetration portion
33 Eccentric shaft
33A End portion
35 Snap ring
37 Limit pin
37A Annular diameter-reduced portion
38 Rubber ring
41 Casing body
43 Cover
43A Boss portion
86 Diameter-reduced portion
44 First lid
46 Second lid
51 First cylindrical portion
51A Motor accommodation space
52 Second cylindrical portion
52A Compression unit accommodating space
54 Annular portion
54*a* Inner peripheral surface
56 Flow passage
61 One end portion
61*a* End surface
61*b*, 33*a* Outer peripheral surface
62 Other end portion
63 Intermediate portion
65 First hole portion
66 Second hole portion

71 Rotor
72 Stator
75 Fixed scroll
75A First end plate portion
75Aa, 76Aa, 81*a* One surface
75Ab, 76Ab, 81*b* Other surface
75B First swirl portion
75C Discharge hole
76 Orbiting scroll
76A Second end plate portion
76B Second swirl portion
76C Boss portion
78 Compression chamber
81 Drive bush body
82 Penetration portion
82A First portion
82B Second portion
84 Third hole portion
85 Recessed portion
92 Base seat portion
92A Press-fitting hole
95 Gap
L Line
$O_1$ First axis
$O_2$ Second axis
$O_3$ Third axis
$O_4$ Center axis
$R_1$ Outer diameter
$R_2$ Inner diameter

The invention claimed is:

1. A scroll compressor comprising:

a fixed scroll which includes a first end plate portion and a first swirl portion formed upright in the first end plate portion;

an orbiting scroll which includes a second end plate portion having one surface facing the first end plate portion, a second swirl portion formed upright in the one surface of the second end plate portion and joining with the first swirl portion to form a compression chamber, and a boss portion formed on the other surface of the second end plate portion located opposite to the one surface and protruding from the other surface;

a shaft which rotates about a first axis and which includes a first hole portion formed on close to one end surface of the shaft facing the other surface of the second end plate portion, the first hole portion extending in the direction of the first axis;

a base seat portion which is integrally formed with the one end surface of the shaft so as to be protruded from the one end surface and which is provided with a press-fitting hole;

a drive bush which includes a drive bush body formed between the second end plate portion and the one end surface of the shaft while being accommodated in the boss portion and is in contact with the one end surface, and a penetration portion penetrating the drive bush body in a direction from the second end plate portion toward the one end surface of the shaft; and an eccentric shaft having a constant outer diameter and extending in a direction of a second axis parallel to the first axis, the eccentric shaft being disposed in the first hole portion, the press-fitting hole through which the first hole portion is exposed, and the penetration portion;

wherein the penetration portion includes a first portion which is disposed close to the orbiting scroll and a second portion which is disposed close to the shaft, the second portion is communicated with the first portion, and a diameter of the second portion is larger than that of the first portion, wherein the eccentric shaft is fitted into the first hole portion and the first portion and is press-inserted into the press-fitting hole, and wherein the base seat portion is fitted onto an outer peripheral surface of the eccentric shaft and is disposed in the second portion with a gap interposed between the base seat portion and the drive bush body, and the gap extends in the direction of the second axis from a contact surface to which the drive bush body and the one end surface are contacted to a surface formed in a radial direction of the second portion.

2. The scroll compressor according to claim 1, wherein the shaft includes a second hole portion which is formed close to the one end surface, wherein a third hole portion is formed in a portion of the drive bush body facing the second hole portion, wherein the scroll compressor further comprises a limit pin which extends in a direction of a third axis parallel to the first and second axes; and a rubber ring which is provided on an outer peripheral surface of the limit pin, wherein a part of the limit pin provided with the rubber ring is accommodated in the second hole portion so that the rubber ring comes into contact with an inner peripheral surface of the second hole portion, and wherein a remaining part of the limit pin is fitted into the third hole portion.

3. The scroll compressor according to claim 2, wherein a center axis of the drive bush is parallel to the first axis, and wherein the second and third axes are disposed at positions passing through a line orthogonal to the center axis.

4. The scroll compressor according to claim 1, wherein an annular diameter-reduced portion is formed in an outer peripheral surface of the drive bush body located close to the shaft, and wherein the scroll compressor further comprises a balance weight which includes a fitting penetration portion fitted to a portion of the drive bush in which the diameter-reduced portion is formed.

5. The scroll compressor according to claim 1, further comprising:

a bush radial bearing which is disposed between an inner peripheral surface of the boss portion and an outer peripheral surface of the drive bush body, wherein the bush radial bearing is a ball bearing, and wherein a material of the drive bush is cast iron.

6. The scroll compressor according to claim 1, further comprising:

a motor which is disposed outside the shaft and rotates the shaft; and a shaft radial bearing which rotatably supports an outer peripheral surface of a portion of the shaft located between the motor and the drive bush, wherein an outer diameter of the base seat portion is smaller than an inner diameter of the shaft radial bearing.

* * * * *